US010961662B1

(12) United States Patent
Murphy

(10) Patent No.: US 10,961,662 B1
(45) Date of Patent: Mar. 30, 2021

(54) ASH RETENTION ADDITIVE AND METHODS OF USING THE SAME

(71) Applicant: POLYMER VENTURES, INC., Charleston, SC (US)

(72) Inventor: Christopher B. Murphy, Burr Ridge, IL (US)

(73) Assignee: POLYMER VENTURES, INC., Charleston, SC (US)

( * ) Notice: Subject to any disclaimer, the term of this patent is extended or adjusted under 35 U.S.C. 154(b) by 0 days.

(21) Appl. No.: 16/726,184

(22) Filed: Dec. 23, 2019

(51) Int. Cl.

| | |
|---|---|
| ***D21H 17/41*** | (2006.01) |
| ***D21H 17/53*** | (2006.01) |
| ***D21H 17/55*** | (2006.01) |
| ***D21H 17/64*** | (2006.01) |
| ***D21H 17/66*** | (2006.01) |
| ***D21H 21/10*** | (2006.01) |
| ***D21H 23/04*** | (2006.01) |
| ***D21H 17/00*** | (2006.01) |
| ***D21H 17/52*** | (2006.01) |
| ***D21H 17/37*** | (2006.01) |
| ***D21H 17/67*** | (2006.01) |
| ***D21H 21/14*** | (2006.01) |
| ***D21H 11/14*** | (2006.01) |
| ***D21H 17/14*** | (2006.01) |

(52) U.S. Cl.
CPC ..... *D21H 17/72* (2013.01); *D21H 11/14* (2013.01); *D21H 17/14* (2013.01); *D21H 17/375* (2013.01); *D21H 17/52* (2013.01); *D21H 17/675* (2013.01); *D21H 21/14* (2013.01); *D21H 23/04* (2013.01)

(58) Field of Classification Search
None
See application file for complete search history.

(56) References Cited

U.S. PATENT DOCUMENTS

| | | | | |
|---|---|---|---|---|
| 3,909,421 | A | 9/1975 | Gaddis | |
| 4,213,885 | A | 7/1980 | Boberg et al. | |
| 4,305,781 | A | 12/1981 | Langley et al. | |
| 5,501,774 | A | 3/1996 | Burke | |
| 5,514,249 | A | 5/1996 | Cauley et al. | |
| 5,645,731 | A | 7/1997 | Burdick et al. | |
| 5,755,930 | A | 5/1998 | Satterfield et al. | |
| 5,827,398 | A | 10/1998 | Depasquale et al. | |
| 6,114,464 | A | 9/2000 | Reck et al. | |
| 6,270,627 | B1 | 8/2001 | Keiser et al. | |
| 6,299,936 | B1 | 10/2001 | Reck et al. | |
| 6,348,530 | B1 | 2/2002 | Reck et al. | |
| 6,358,365 | B1 * | 3/2002 | Zhang | C01B 33/32 162/181.2 |

(Continued)

OTHER PUBLICATIONS

Smook, Gary A., Handbook for Pulp and Paper Technologists, 2nd ed, Angus Wilde Publications, 1992, pp. 1-4,36,209 and 228. (Year: 1992).*

(Continued)

*Primary Examiner* — Dennis R Cordray
(74) *Attorney, Agent, or Firm* — Marshall, Gerstein & Borun LLP

(57) ABSTRACT

Provided herein are additives for paper compositions comprising poly(ethylene oxide) (PEO) and polyacrylamide polymer that are capable of increasing the ash retention of the paper composition. Also provided are methods of making a paper composition using the additives of the disclosure.

30 Claims, 1 Drawing Sheet

(56) References Cited

U.S. PATENT DOCUMENTS

| | | | | |
|---|---|---|---|---|
| 6,361,652 | B2 | 3/2002 | Keiser et al. | |
| 6,461,477 | B1 | 10/2002 | Nguyen et al. | |
| 6,686,417 | B1 * | 2/2004 | Reekmans | C02F 1/56 524/277 |
| 7,244,339 | B2 | 7/2007 | Vergara Lopez | |
| 9,051,687 | B2 | 6/2015 | Esser et al. | |
| 9,149,789 | B2 | 10/2015 | Holt | |
| 9,346,693 | B2 | 5/2016 | Holt | |
| 9,714,342 | B2 | 7/2017 | Holt et al. | |
| 9,765,483 | B2 | 9/2017 | Esser et al. | |
| 9,776,900 | B2 | 10/2017 | Zou et al. | |
| 9,856,159 | B2 | 1/2018 | Holt | |
| 9,908,976 | B2 | 3/2018 | Holt | |
| 9,988,531 | B2 | 6/2018 | Holt | |
| 10,004,667 | B2 | 6/2018 | Yamazaki et al. | |
| 10,011,717 | B2 | 7/2018 | Holt | |
| 2001/0023753 | A1 | 9/2001 | Keiser et al. | |
| 2001/0030032 | A1 | 10/2001 | Keiser et al. | |
| 2003/0153675 | A1 | 8/2003 | Riondel et al. | |
| 2003/0166771 | A1 | 9/2003 | Riondel et al. | |
| 2003/0171489 | A1 | 9/2003 | Riondel et al. | |
| 2004/0221977 | A1 | 11/2004 | Vergara Lopez | |
| 2005/0056390 | A1 | 3/2005 | Neivandt et al. | |
| 2009/0194484 | A1 | 8/2009 | Lockledge et al. | |
| 2013/0316055 | A1 | 11/2013 | Holt | |
| 2016/0101166 | A1 | 4/2016 | Salamone et al. | |
| 2016/0199459 | A1 | 7/2016 | Salamone et al. | |
| 2017/0247272 | A1 | 8/2017 | Holt | |
| 2018/0327972 | A1 | 11/2018 | Zhang et al. | |

OTHER PUBLICATIONS

Britt, K. "Mechanisms of Retention During Paper Formation", Tappi, vol. 56, No. 10 (1973), pp. 46-50. (Year: 1973).*

* cited by examiner

ASH RETENTION ADDITIVE AND METHODS OF USING THE SAME

BACKGROUND

Field of the Disclosure

The disclosure generally relates to an additive for a paper composition that includes a polyacrylamide polymer and poly(ethylene oxide).

Brief Description of Related Technology

In the paper and paperboard manufacturing industry, fillers play an important role in saving cost and improving various properties of paper. Most papermakers add fillers, such as ground calcium carbonate, precipitated calcium carbonate, kaolin, and talc, in order to replace a portion of the fiber material without negatively impacting the properties of the final paper. Fillers can be added to affect the physical properties to the final paper, such as opacity, brightness, smoothness, and uniformity to the paper, and can also be included as a fiber replacement, leading to direct cost savings. However, as the filler content in a paper composition increases, there can be reduced retention of the filler throughout the manufacturing process, leading to decreased machine performance, as well as reduced strength and/or physical properties of the final paper product. Thus, a paper manufacturer's ability to increase filler content in a paper composition is limited.

SUMMARY

Improved ash retention throughout the papermaking process can beneficially results in improved physical properties of the final paper and/or increased fiber replacement, which can beneficially reduce costs.

In embodiments, an additive for a paper composition can include poly(ethylene oxide) (PEO) and a polyacrylamide polymer. The PEO can be present in an amount of about 1 wt % to about 15 wt %, based on the total weight of the additive, and the polyacrylamide polymer can be present in an amount of about 20 wt % to 40 wt %, based on the total weight of the additive. The additive is capable of increasing ash retention of a paper composition by at least about 25% relative to ash retention of a paper composition having an additive comprising PEO alone, an additive comprising polyacrylamide polymer alone, or the separate addition of both an additive comprising PEO alone and an additive comprising polyacrylamide polymer alone.

In embodiments, an additive for a paper composition can include a polyacrylamide polymer and a dispersion including poly(ethylene oxide) (PEO). The additive is capable of increasing ash retention of a paper composition by at least about 25% relative to ash retention of a paper composition having an additive comprising the PEO alone, an additive comprising polyacrylamide polymer alone, and the separate addition of both an additive comprising PEO alone, and/or an additive comprising polyacrylamide polymer alone.

In embodiments, an additive for a paper composition can include poly(ethylene oxide) (PEO) and a polyacrylamide polymer emulsion. The PEO can be present in an amount no greater than 15 wt %, based on the total weight of the additive. The additive is capable of increasing ash retention of a paper composition by at least about 25% relative to ash retention of a paper composition having an additive comprising PEO alone, an additive comprising polyacrylamide polymer alone, and the separate addition of both an additive comprising PEO alone, and/or an additive comprising polyacrylamide polymer alone.

In embodiments, an additive for a paper composition can include poly(ethylene oxide) (PEO) and a polyacrylamide polymer. The ratio of the PEO to the polyacrylamide polymer can range from about 1:2 to about 1:40. The additive is capable of increasing ash retention of a paper composition by at least about 25% relative to ash retention of a paper composition having an additive comprising PEO alone, an additive comprising PEO alone, an additive comprising polyacrylamide polymer alone, and the separate addition of both an additive comprising PEO alone, and/or an additive comprising polyacrylamide polymer alone.

In embodiments, an additive for a paper composition can include a dispersion including poly(ethylene oxide) (PEO) and a polyacrylamide polymer emulsion. The additive is capable of increasing ash retention of a paper composition by at least about 25% relative to ash retention of a paper composition having an additive comprising PEO alone, an additive comprising PEO alone, an additive comprising polyacrylamide polymer alone, and the separate addition of both an additive comprising PEO alone, and/or an additive comprising polyacrylamide polymer alone.

In accordance with embodiments, a method of making a paper composition can include admixing a pulp stock and the additive of the disclosure to provide a paper composition furnish, wherein the pulp stock comprises a fiber matrix and a filler material, and drying the paper composition furnish to provide a paper composition. The paper composition has an ash retention that is at least about 25% higher than a paper composition that does not comprise the polyacrylamide polymer or PEO or a paper composition in which the polyacrylamide polymer and the PEO were separately added.

Further aspects and advantages of the disclosure will be apparent to those of ordinary skill in the art from a review of the following detailed description. While the compositions and methods are susceptible of embodiments in various forms, the description hereafter includes specific embodiments, with the understanding that the disclosure is illustrative, and is not intended to limit the scope of the disclosure to the specific embodiments described herein.

DETAILED DESCRIPTION

Figure 1:
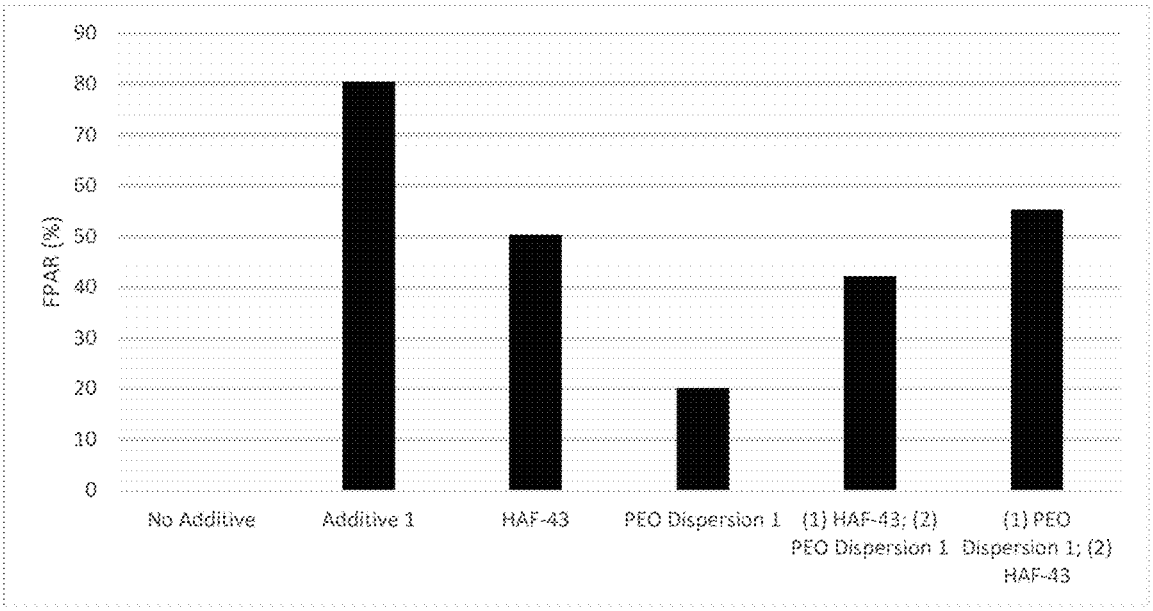
FIG. 1 is a graph showing the ash retention (%) of old corrugated cardboard pulp stock having no additive, an additive according to the disclosure (Additive 1), a polyacrylamide polymer additive (HAF-43), a PEO additive (PEO Dispersion 1), having the separate and sequential addition of polyacrylamide polymer and PEO, and having the separate and sequential addition of PEO and polyacrylamide polymer.

Surprisingly, it has been found that the use of an additive comprising the combination of poly(ethylene oxide) and a polyacrylamide polymer can significantly increase the ash retention, also referred to herein as ash retention, of a paper product. Significantly, the results achieved by the combined use of PEO and polyacrylamide polymer in the additive described herein demonstrates a more-than-additive effect as compared to the known ash retention aid of PEO and polyacrylamide polymer, separately, in the same amounts as the additive of the disclosure. This improved ash retention performance of the additives of the disclosure can allow for the use of reduced amounts of the PEO and polyacrylamide polymer, without sacrificing ash retention performance. In fact, it has been surprisingly found that amounts of PEO and polyacrylamide in the additives of the disclosure can be less than would be expected to achieve any ash retention based on the known individual ash retention aid performance of PEO and polyacrylamide.

It was generally expected in the art that at least 15 wt % of PEO was needed in a papermaking additive composition for ash retention. At typical industry dosing amounts of about 0.25 to about 4 PPT of additive, this results in about 0.1 to about 2 PPT PEO as the expected amount of PEO needed for ash retention. By contrast, the additive of the disclosure can achieve at least substantially the same, if not improved additive performance (e.g., ash retention) at significantly lower than expected amounts of PEO. In particular, when the additive of the disclosure is dosed to a pulp stock in typical industry amounts of about 0.25 to about 4 PPT, the amount of PEO in the pulp stock can be about 0.0025 PPT to about 1 PPT, for example at least about 0.0025, 0.003, 0.005, 0.0075, 0.01, 0.05, 0.08, 0.1, or 0.2 PPT and/or up to about 1, 0.9, 0.8, 0.7, 0.6, 0.5, 0.4, 0.3, 0.2, 0.1, or 0.05 PPT.

Similarly, it was expected that, at typical industry dosing amounts of about 0.25 to about 4 PPT of additive, the amount of polyacrylamide polymer needed for ash retention was about 0.075 to about 1.2 PPT. By contrast, the additive of the disclosure can achieve at least substantially the same, if not improved, additive performance (e.g., ash retention) at significantly lower than expected amounts of polyacrylamide polymer. In particular, when the additive is dosed to a pulp stock in typical industry amounts of about 0.25 to about 4 PPT, the amount of polyacrylamide polymer in the pulp stock is about 0.02 PPT to about 2 PPT, for example at least about 0.02, 0.05, 0.08, 0.1, 0.5, 0.8, or 1 PPT and/or up to about 2, 1.5, 1, 0.8, 0.6, 0.3, or 0.06 PPT.

Surprisingly, it was not expected that the combination of PEO and a polyacrylamide polymer, as described herein, could provide a more-than-additive increase in the ash retention. Rather, it would have been expected that adding the combination of PEO and a polyacrylamide polymer would merely result in the same increase in ash retention that would have been obtained by adding the PEO and polyacrylamide polymer, separately. Prior testing of the separate addition of PEO and polyacrylamide in the same amounts as provided by the additive did not provide a suitable ash retention such that a carbonate filler could be financially justified for papermakers. Advantageously, the additive described herein can provide a suitable ash retention such that at least about 200, 225, 250, 275 or 300 PPT of carbonate can be used as a filler and provide a substantial economic benefit as a result an increased amount of additive, which can be used, as well as the significant reduction in the amounts of PEO and polyacrylamide needed to achieve such performance as compared to conventional ash retention additives.

The additive of the disclosure can obtain an ash retention of at least 50%, 55%, 60%, 65%, 70%, 75%, 80%, 85%, 90%, or 95%. The ash retention can vary based on the level of impurities in the initial stream of pulp stock. Advantageously, the additive disclosed herein can obtain these levels of ash retention at lower levels of PEO and polyacrylamide polymer than would be conventionally expected, and lower levels than can be achieved by the sole addition of polyacrylamide polymer as the ash retention aid, the sole addition of PEO as the ash retention aid, and the separate addition of polyacrylamide polymer and PEO as ash retention aids. Moreover, the ash retention that can be achieved by the additive of the disclosure can be greater than the expected combined ash retention that can be achieved by each of the PEO and the polyacrylamide polymer, alone, based on their individual performance.

Additive Composition

In embodiments, the disclosure provides an additive for a paper composition. In embodiments, the additive includes poly(ethylene oxide) (PEO) and a polyacrylamide polymer. In embodiments, the additive of the disclosure is capable of increasing ash retention of a paper composition by at least about 25% relative to ash retention of a paper composition having an additive comprising PEO alone, an additive comprising PEO alone, or the separate addition of both an additive comprising PEO alone and/or an additive comprising polyacrylamide polymer alone.

In embodiments, the PEO is present in an amount of about 1 wt % to about 15 wt %, about 3 wt % to about 15 wt %, about 5 wt % to about 15 wt %, about 1 wt % to about 12 wt %, about 1 wt % to about 10 wt %, about 2 wt % to about 10 wt %, about 3 wt % to about 10 wt %, or about 2 wt % to about 5 wt %, or about 5 wt % to about 10 wt %, for example at least about 1, 2, 3, 4, 5, 6, 7, 8, 9, or 10 wt % and/or up to about 15, 14, 13, 12, 11, 10, 9, 8, 7, 6, or 5 wt %, based on the total weight of the additive. In embodiments, the PEO is present in an amount no greater than about 15 wt %, based on the total weight of the additive. In embodiments, the PEO is present in an amount less than about 15 wt %, based on the total weight of the additive. In embodiments, the amount of PEO in the pulp stock can be about 0.0025 PPT to about 1 PPT, for example at least about 0.0025, 0.003, 0.005, 0.0075, 0.01, 0.05, 0.08, 0.1, or 0.2 PPT and/or up to about 1, 0.9, 0.8, 0.7, 0.6, 0.5, 0.4, 0.3, 0.2, 0.1, or 0.05 PPT. Prior to the present disclosure, it was generally expected that at least 15 wt % of PEO was needed in a papermaking additive composition in order to achieve suitable ash retention. Similarly, it was believed that the typical PEO dose of 0.1 to 2 PPT would be required to obtain a suitable ash retention. Surprisingly, the inventors found that, when in combination with a polyacrylamide polymer as described below, the amount of PEO in a papermaking additive composition, as well as when admixed with a pulp stock, could be decreased without negatively affecting the physical properties of the final paper product.

In embodiments, the polyacrylamide polymer is present in an amount of about 20 wt % to 40 wt %, about 25 wt % to about 35 wt %, about 20 wt % to about 30 wt %, about 20 wt % to about 25 wt %, about 25 wt % to about 40 wt %, or about 25 wt % to about 30 wt %, for example at least about 20, 22, 25, 27, 29, 30, 32 or 35 wt % and/or up to about 40, 37, 35, 32, 30, 29, 27, or 25 wt %, based on the total weight of the additive. In embodiments, when the additive is dosed to a pulp stock in typical industry amounts of about 0.25 to about 4 PPT, the amount of polyacrylamide polymer in the pulp stock is about 0.02 PPT to about 2 PPT, for example at least about 0.02, 0.05, 0.08, 0.1, 0.5, 0.8, or 1 PPT and/or up to about 2, 1.5, 1, 0.8, 0.6, 0.3, or 0.06 PPT. In embodiments, the polyacrylamide polymer is in the form of an emulsion.

In embodiments, the additive includes a polyacrylamide polymer emulsion and a dispersion of PEO. Without intending to be bound by theory, it is believed that when the additive is prepared as a blend of a dispersion of PEO and an emulsion of polyacrylamide polymer, the additive includes a dispersion of insoluble PEO particles amongst micelles of water-soluble polyacrylamide polymer entrapped in oil. When the additive is added to water at amounts of at least about 1%, for example, the micelles rupture, thereby exposing the high molecular weight polyacrylamide polymers to an abundance of water, allowing the polymer to unravel, hydrate, and solubilize in the water. Also when added to water, the dispersed insoluble PEO particles begin to solubilize, but at a slower rate than the polyacrylamide polymer. Therefore, without intending to be bound by theory, it is believed that the quick hydration of the polyacrylamide polymer and the slow hydration of PEO synergistically creates a webbed polymer structure that leads to enhanced ash retention.

In embodiments, the ratio of PEO to polyacrylamide polymer ranges from about 1:2 to about 1:40, about 1:2 to about 1:30, about 1:3 to about 1:15, about 1:5 to about 1:15, about 1:6 to about 1:15, about 1:6 to about 1:9, or about 1:8 to about 1:10, for example about 1:2, 1:3, 1:4, 1:5, 1:6, 1:7, 1:8, 1:9, 1:10, 1:11, 1:12, 1:13, 1:14, 1:15, 1:20, 1:25, 1:30, 1:35, or 1:40.

The additive can further include a salt. Examples of suitable salts include, but are not limited to sodium formate, potassium formate, sodium hydroxide, potassium hydroxide, sodium citrate, potassium citrate, sodium acetate, potassium acetate, sodium chloride, potassium chloride, and mixtures thereof. In embodiments, the additive includes sodium formate or potassium formate. In embodiments, the additive includes sodium hydroxide or potassium hydroxide. In embodiments, the additive includes sodium citrate or potassium citrate. In embodiments, the additive includes sodium acetate or potassium acetate. In embodiments, the additive includes sodium chloride or potassium chloride. In embodiments, the additive includes sodium formate.

The additive can further include one or more auxiliary agents. Examples of auxiliary agents include emulsifiers, viscosity modifiers, dispersants, dye fixatives, dry strength agents, and wet strength agents. In embodiments, the additive includes one or more of an emulsifier, a viscosity modifier, a dispersant, a dye fixative, a dry strength agent, a wet strength agent, and any combination thereof. In embodiments, the auxiliary agent includes one or more of poly (ethylene glycol) (PEG), alum, polyaluminum chloride, sodium alginates, polyamines, polyethylene imine, polydiallyldimethyl ammonium chloride, poly-epichlorohydrin-dimethylamine, and polyguanidine. In embodiments, the additive includes PEG. The average molecular weight of the PEG can range from about 100 g/mol to about 2000 g/mol, about 200 g/mol to about 1000 g/mol, about 100 g/mol to about 800 g/mol, about 200 g/mol to about 600 g/mol, or about 200 g/mol to about 500 g/mol, for example about 100, 200, 300, 400, 500, 600, 700, 800, 900, 1000, 1200, 1400, 1600, 1800, or 2000 g/mol. In embodiments, the additive includes a PEG having an average molecular weight of about 200 g/mol (i.e., PEG 200).

In embodiments, the additive is aqueous. That is, in embodiments, the additive includes water, whether added intentionally to the additive composition, or added as a solvent of one or more of the polyacrylamide polymer, the PEO, and any other auxiliary agent. The additive can include up to about 80 wt % water or less, for example about 80 wt %, about 75 wt %, about 70 wt %, about 60 wt %, about 50 wt %, about 40 wt %, about 30 wt %, about 25 wt %, about 20 wt %, about 10 wt %, about 5 wt %, or less, based on the total weight of the additive.

As described herein, the additive is capable of increasing ash retention of a paper composition by at least about 25% relative to ash retention of a paper composition having an additive comprising PEO alone, or polyacrylamide polymer alone. For example, the additive is capable of increasing ash retention of a paper composition by at least about 25%, about 26%, about 27%, about 28%, about 29%, about 30%, about 31%, about 32%, about 33%, about 34%, about 35%, about 37%, about 40%, about 42%, about 45% about 47%, about 50%, or about 55% relative to ash retention of a paper composition having an additive comprising PEO alone, or the polyacrylamide polymer, alone. In embodiments, the additive is capable of increasing the ash retention of a paper composition by at least about 25%, relative to an additive comprising the polyacrylamide polymer, alone. In embodiments, the additive is capable of increasing the ash retention of a paper composition by at least about 50%, relative to an additive comprising PEO, alone.

As used herein, the amounts of ash retention "relative to an additive comprising PEO, alone," "relative to an additive comprising polyacrylamide polymer, alone," and "relative to an additive comprising PEO alone, or the polyacrylamide polymer alone" refer to an additive comprising the same amount (i.e., the same wt %) of the component (i.e., polyacrylamide polymer and/or PEO) as used in the additive according to the disclosure. That is, in embodiments, an additive according to the disclosure, including, for example, 5 wt % PEO and 30 wt % polyacrylamide polymer, is capable of increasing the ash retention of a paper composition by at least about 25% relative to an additive comprising 5 wt % PEO, alone, and/or 30 wt % polyacrylamide polymer, alone. It should be understood herein that "an additive comprising PEO alone" or "an additive comprising polyacrylamide polymer alone" refers to an additive that has PEO or polyacrylamide polymer as the only ash retention additive. Other components not related to ash retention can be included in the comparative additive. For example, by "PEO alone" and/or "polyacrylamide polymer alone" it is meant that the additive is free of polyacrylamide polymer and free of PEO, respectively. That is, the additive does not include the polyacrylamide polymer and/or the PEO, but it may optionally comprise salts and/or other auxiliary agents, as described herein.

In embodiments, the additive is capable of increasing the ash retention of a paper composition more than an amount expected by the additive effect of polyacrylamide polymer alone and PEO alone. For example, the additive of the disclosure may provide an increase in ash retention by at least about 10% of the expected combined ash retention achieved by an additive comprising the polyacrylamide polymer, alone, and an additive comprising the PEO, alone based on the individual additive performance.

Methods of Use

In embodiments, the disclosure provides a method of making a paper composition. The method can include admixing a pulp stock and the additive according to the disclosure to provide a paper composition furnish, and drying the paper composition furnish to provide a paper composition. As described herein, in embodiments, the paper composition has an ash retention that is at least about 25% higher than a paper composition that does not include the polyacrylamide polymer or PEO. The ash retention can be measured according to Test 3, as described in detail in the Examples.

In embodiments, the additive, having the PEO and the polyacrylamide polymer as a single composition, is prepared and subsequently admixed with the pulp stock. Without intending to be bound by theory, it is believed that premixing the two polymers to form the additive composition prior to mixing with the pulp stock can improve the intermingling of the two polymers, thereby forming a polymer structure that can improve the binding of the additive to the filler material, leading to improved ash retention. It is believed that if the PEO and the polyacrylamide were added separately, the other components of the admixture (e.g., the filler material, the fiber matrix, any salts, and/or any auxiliary agents) could interfere with the polymer structure formed between the polyacrylamide polymer and the PEO, leading to decreased binding to the filler material, and therefore, lower ash retention. For example, the additive of the disclosure can result in an at least 25% increase in ash retention as compared to the ash retention achieved by adding both the PEO and the polyacrylamide polymer, but as separate additive additions. For example, as illustrated in FIG. 1, an embodiment of the additive of the disclosure can result in an approximately 40% increase in ash retention as compared to the separate addition of polyacrylamide polymer followed by addition of the PEO, and an approximately 25% increase in ash retention as compared to the separate addition of the PEO followed by the polyacrylamide polymer.

In embodiments, the pulp stock includes a fiber matrix and a filler material. The pulp stock can have a consistency (in percent) of about 0.05% to about 4%, about 0.05% to about 3.0%, about 0.06% to about 2.0%, about 0.1% to about 1.0%, about 0.2% to about 0.9%, about 0.3% to about 0.8%, about 0.4% to about 0.7%, or about 0.5% to about 0.6%, for example at least about 0.05, 0.06, 0.08, 0.1, 0.2, 0.3, 0.4, 0.5, or 0.6% and/or up to about 4.0, 3.5, 3.0, 2.5, 2.0, 1.5, 1.0, 0.9, 0.8, 0.7, 0.6, 0.5, or 0.4%.

Any known fiber matrix materials or combinations of materials can be used. For example, the fiber matrix can include old corrugated cardboard (OCC), fine paper, old news print (ONP), mixed office waste (MOW), virgin pulp, bleached or unbleached kraft pulp, bleached or unbleached sulphite pulp, recycled fibers, refined cellulose fiber, chemical pulp, mechanical pulp, thermo-mechanical pulp, or mixtures thereof. In some cases, the fiber matrix can include residual filler material, as the fiber matrix can be derived from a recycled paper material (e.g., ONP, MOW, OCC, or fine paper, etc.) which includes a filler material.

In embodiments, the filler material can be any known filler material. For example, the filler material can include clay, kaolin, ground calcium carbonate (GCC), precipitated calcium carbonate (PCC), titanium dioxide, talc, a starch, polyvinyl alcohol, carboxymethylcellulose, or a mixture thereof. In embodiments, the filler material includes GCC. In embodiments, the filler material includes PCC. In embodiments, the filler material includes titanium dioxide. In embodiments, the filler material includes talc. In embodiments, the filler material includes a starch (e.g., a modified or an unmodified starch). In embodiments, the filler material includes a blend of any of the foregoing, for example, GCC or PCC with talc, titanium, and/or kaolin. Any combination known and practiced in the art can be used as described herein. In embodiments, the filler material includes polyvinyl alcohol (e.g., a polyvinyl alcohol homopolymer or an anionic group-modified polyvinyl alcohol copolymer). In embodiments, the filler material includes carboxymethylcellulose.

The filler material can be included in an amount ranging from at least about 10, 25, 50, 75, 100, 150, 200, 250, 300, or 350 PPT and/or up to about 500, 450, 400, 350, 300, 250, or 200 PPT, for example about 10, 25, 50, 75, 100, 150, 200, 250, 300, 350, 400, 450, or 500 PPT. In embodiments, the filler material is included in an amount ranging from about 10 PPT to about 500 PPT. In embodiments, the filler material is included in an amount ranging from about 100 PPT to about 500 PPT. In embodiments, the filler material is included in an amount ranging from about 200 PPT to about 300 PPT. The amounts of filler material, as described herein, do not account for any residual filler material present in a fiber matrix material derived from a recycled paper material. That is, as described herein, the amounts of filler material correspond to the amount of intentionally added filler material.

The additive can be added in amount ranging from about 0.1 lbs/ton (PPT) to about 5 PPT, about 0.1 PPT to about 4 PPT, about 0.5 lbs/ton to about 5 PPT, about 0.75 PPT to about 4 PPT, about 1 PPT to about 3 PPT, or about 1.5 PPT to about 2 PPT, for example about 0.10, 0.20, 0.30, 0.40, 0.50, 0.75, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.2, 3.4, 3.6, 3.8, 4.0, 4.2, 4.4, 4.6, 4.8, or 5.0 PPT. In embodiments, the additive is added in an amount of at least about 1.7 PPT. In embodiments, the additive is added in an amount of at least about 2.1 PPT.

Advantageously, and without intending to be bound by theory, the ash retention of a paper composition including the additive of the disclosure is believed to increase as the amount of additive (in terms of PPT) increases, up to about 5 PPT and at least up to about 3 PPT. In contrast, the ash retention of a paper composition including an additive having PEO alone and/or polyacrylamide polymer alone, is believed to plateau at an amount within this range, for example, at about 2.0 PPT, and no longer increase with the addition of additive.

The additive and methods disclosed herein can be used to manufacture any suitable paper product, or paper composition. In embodiments, the paper composition is a newsprint, a supercalendered paper, a coated mechanical paper, a woodfree uncoated paper, a woodfree coated paper, a copy paper, a digital printing paper, a continuous stationery, a fine paper, a cartonboard, a containerboard, a cardboard, a linerboard, a wallpaper, a wrapping paper, an envelope paper, a molded container, or a molded pulp shipping liner. Advantageously, when the paper product is formed, in part, through the use of a vacuum process (i.e., to help remove moisture during manufacture), use of the additive of the disclosure can maintain the enhanced ash retention of the final paper product, whereas use of polyacrylamide or PEO, alone, cannot.

In embodiments, the paper composition furnish further includes a salt. The salt can be any of those described herein with respect to the additive composition. The salt can be included in the paper composition furnish by way of the additive composition (i.e., the additive composition includes a salt). Alternatively, or additionally, the salt can be included in the paper composition furnish separately from the additive composition (e.g., by direct addition to the pulp stock).

In embodiments, the paper composition furnish further includes an auxiliary agent. The auxiliary agent can be any of those described herein with respect to the additive composition. The auxiliary agent can be included in the paper composition furnish by way of the additive composition (i.e., the additive composition includes a salt). Alternatively, or additionally, the auxiliary agent can be included in the paper composition furnish separately from the additive composition (e.g., by direct addition to the pulp stock).

The auxiliary agent can be included in an amount not exceeding about 5 PPT. For example, in embodiments, the auxiliary agent is added in an amount of less than about 5

PPT, less than about 4 PPT, less than about 3 PPT, less than about 2 PPT, less than about 1.5 PPT, less than about 1.0 PPT, or less than about 0.5 PPT.

In embodiments, a salt and/or auxiliary agent can be included in the additive composition, only (i.e., no salt or auxiliary is intentionally added to the paper composition furnish separately from the additive composition). The term "intentionally added," should be understood to mean that a salt and/or auxiliary agent may be present in the paper composition furnish as a residual ingredient (e.g., when the fiber matrix is a recycled paper product, such as OCC), but that no additional salt and/or auxiliary agent is purposefully added to the furnish. In embodiments, a salt and/or auxiliary agent can be included in the paper composition furnish, added separately from the additive composition (i.e., the additive composition can be substantially free of the salt or auxiliary agent). As used herein, "substantially free of the salt or auxiliary agent" means that the additive composition suitably contains less than about 5 wt %, 4 wt %, 3 wt %, 2 wt %, 1 wt %, 0.5 wt %, 0.1 wt %, or 0.01 wt % of the salt or auxiliary agent. In embodiments, at least one salt and/or auxiliary agent can be included in the additive composition, and a different salt and/or auxiliary agent can be included in the paper composition furnish, added separately from the additive composition. In embodiments, a salt and/or auxiliary agent can be included in the additive composition, and the same salt and/or auxiliary agent can also be included in the paper composition furnish separately from the additive composition. In embodiments, the additive composition includes at least one salt and/or one auxiliary agent. In embodiments, the paper composition furnish includes at least one salt and/or auxiliary agent added separately from the additive composition.

When included, each of the salt and the one or more additional paper composition furnish components can be added at any time, or over a span of times (e.g., incrementally) that is appropriate and/or generally done in the art of papermaking. For example, the salt and/or the one or more additional paper composition furnish components can be added to the pulp stock prior to the additive. Alternatively, or additionally, the salt and/or the one of more additional paper composition furnish components can be added after the addition of the additive.

EXAMPLES

Seven additives were prepared and were evaluated for 1st Pass Retention and Ash Retention. The procedures used to determine these parameters were as follows:

Test Procedures

Test 1: Procedure to Determine Consistency

1) Dry Whatman 43 filter paper in speedy dryer for 15 minutes.
2) Weigh filter paper and record weight (mass) after 1 minute ($m_i$)
3) While filter paper is drying, mix pulp stock until uniform.
4) Pull 100 mL sample of pulp stock and vacuum filter sample through dried filter (mass of the 100 mL sample=$m_p$)
5) Dry the filter paper (and filtrate) for 15 minutes in speedy dryer at 115° C.
6) Weight filter paper and record weight (mass) of final filter paper after 1 minute ($m_f$)
7) Consistency=$(m_f-m_i)/(m_p)\times 100\%$ Test 2: Procedure to Determine 1st Pass Retention (FPR)

1) Mix pulp stock (0.5% consistency) for 1 hour at 45° C.
2) Add 500 mL of pulp stock to Britt Dynamic Drainage Jar with mixing at 750 rpm.
3) Mix pulp for 30 seconds, adding products in 30 second intervals for a total mixing time of 2.5 minutes.
4) After 2.5 minutes, collect 100 mL sample for filtering.
5) Dry Whatman 43 filter paper in speedy dryer for 15 minutes at 115° C. Record weight (mass) of dried filter paper ($m_i$).
6) Vacuum filter the 100 mL sample through the dried filter paper.
7) Dry the filter paper (and filtrate) in speedy dryer for 15 minutes at 115° C. Record weight (mass) of final filter paper ($m_f$).
8) FPR=[(Consistency %)−($m_f$−$m_i$)]/(Consistency %)×100

Test 3: Procedure to Determine Ash Retention

1) Preheat the furnace to 650° C.
2) Heat crucible and crucible lid in furnace for 15 minutes.
3) Remove crucible and lid from furnace and record weight (mass) after 90 seconds ($m_{c,i}$)
4) Place dried filter paper sample to be ashed in crucible, cover, and place in furnace for 1 hour.
5) Remove the crucible and record weight (mass) after 90 seconds ($m_{c,f}$).
6) Ash Retention=[(Average Blank Retention)−($m_{c,f}$−$m_{c,i}$)]/(Average Blank Retention)×100%. Average Blank Retention is measure first.

As detailed above, the percent ash retention correlates to the amount of filler retained during the papermaking process.

Additive Preparation

Seven additives were prepared as follows:

PEO Dispersion 1

PEO Dispersion 1 was prepared by adding 45 g of POLYOX™ 308 (>95% active; DuPont) PEO to 155 g of polyethyleneglycol (PEG) 200 using an overhead mixer, and mixed until uniform. After mixing, the dispersed PEO was then mixed via a Laboratory Silverson homogenizer (Model #L5M-A) at 8000 rpm for 2 minutes, in order to breakdown the particle size of the PEO.

PEO Dispersion 2

PEO Dispersion 2 was prepared by adding 46.8 g of sodium formate to 109.2 g of distilled water and mixed until dissolved. To the dissolved sodium formate solution, 44 g of POLYOX™ 308 was added and mixed until homogeneous. After mixing, the dispersed PEO was then mixed via a Laboratory Silverson homogenizer (Model #L5M-A) at 8000 rpm for 2 minutes, in order to breakdown the particle size of the PEO.

Additive 1

Additive 1 was prepared by adding 13 g of PEO Dispersion 1 to 87 g of an anionic polyacrylamide emulsion (HAF-43; 28-30% activity; Polymer Ventures, Inc.) and mixed via an overhead mixer until homogeneous. A flowable emulsion with dispersed particles was obtained.

Additive 2

Additive 2 was prepared in the same way as Additive 1, but PEO Dispersion 1 was replaced with PEO Dispersion 2.

Additive 3

Additive 3 was prepared by slowly adding 6 g of POLYOX™ 308 to 194 g of HAF-43 using an overhead mixer. A flowable emulsion with dispersed particles was obtained.

Additive 4

Additive 4 was prepared by slowly adding 10 g of POLYOX™ 308 to 190 g of HAF-43 using an overhead mixer. A flowable emulsion with dispersed particles was obtained.

Additive 5

Additive 5 was prepared by slowly added 20 g of POLYOX™ 308 to 180 g of HAF-43 using an overhead mixer. A thick liquid was obtained. Over time, the liquid was no longer fluid.

A summary table of the amount of PEO and polyacrylamide in the additives is provided in Table 1, below.

TABLE 1

| Additive No. | PEO (wt % based on weight of the additive)* | Polyacrylamide (wt % based on weight of the additive)** | Additional Additive Component(s) |
|---|---|---|---|
| PEO Dispersion 1 | 22.5 | 0 | PEG |
| PEO Dispersion 2 | 22 | 0 | $NaCO_2H$ |
| 1 | 2.9 | 26.1 | PEG |
| 2 | 2.9 | 26.1 | $NaCO_2H$ |
| 3 | 3.0 | 29.1 | None |
| 4 | 5.0 | 28.5 | None |
| 5 | 10.0 | 27.0 | None |

*An activity of 100% is assumed for POLYOX ™ PEO calculations

**An activity of 30% is assumed for HAF-43 polyacrylamide calculations.

All additive samples were diluted to 1 wt % prior to ash retention testing.

Example 1—Ash Retention Testing in Corrugated Cardboard

Old corrugated cardboard (OCC) was pulped to about 0.5% consistency. A 500 mL sample of the pulp was added to a dynamic drainage jar (DDJ) and mixed. Ground calcium carbonate (GCC) was added to the pulp as a filler in an amount of 200 pounds per ton (PPT) and mixed. The pulp was dosed with 2 PPT of a solution coagulant (PV-032; Polymer Ventures, Inc.). A 2 PPT sample of one of (a) anionic polyacrylamide flocculant alone (HAF-43); (b) PEO Dispersion 1; or one of (c) Additives 1-5 was added, and the FPR and ash retention were determined. This procedure was repeated 5 times for each flocculant/additive, and the averages were determined. The results for Additive 1, as compared to a polyacrylamide flocculant, alone, and a PEO dispersion, alone, are shown in FIG. 1. In FIG. 1, the black lines represent that percent FPR and the dashed lines represent the percent ash retention.

The testing using the polyacrylamide flocculant alone was done at a concentration of the polyacrylamide flocculant that was the same as the concentration of the polyacrylamide flocculant in Additive 1. As shown in the FIG. 1, use of polyacrylamide (HAF-43) alone at the same concentration as the polyacrylamide in Additive 1 resulted in an ash retention of 50.32%, and the use of PEO Dispersion 1 alone resulted in an ash retention of 20.12%. The combined use, in Additive 1, however, surprisingly resulted in a more than additive effect, increasing the ash retention to 80.46%.

Each of Additives 2-4 demonstrated similar results.

Surprisingly, the additive, when prepared as a blend of a dispersion and an emulsion and subsequently added to the pulp, performed significantly better as compared to when the additive was prepared in situ, that is, by adding the PEO (in the same amount as the additive) to the pulp followed by the polyacrylamide (in the same amount as the additive), or vice versa. In particular, as shown in FIG. 1, when the PEO dispersion was first added to the pulp, followed by the polyacrylamide emulsion (in the same amounts as used with Additive 1), the ash retention was only 55.33%. Similarly, when the polyacrylamide emulsion was added to the pulp prior to the PEO (in the same amounts as used with Additive 1), the ash retention was only 42.19%. Accordingly, it was surprisingly found that the additive provides significantly improved ash retention. Without intending to be bound by theory, it is believed that this improved ash retention for the additive prepared prior to adding to the pulp was because the two polymers (i.e., PEO and polyacrylamide) can intermingle and create a structure that has improved binding to the filler material.

Example 2: Ash Retention Testing in Fine Paper

Figure 2:
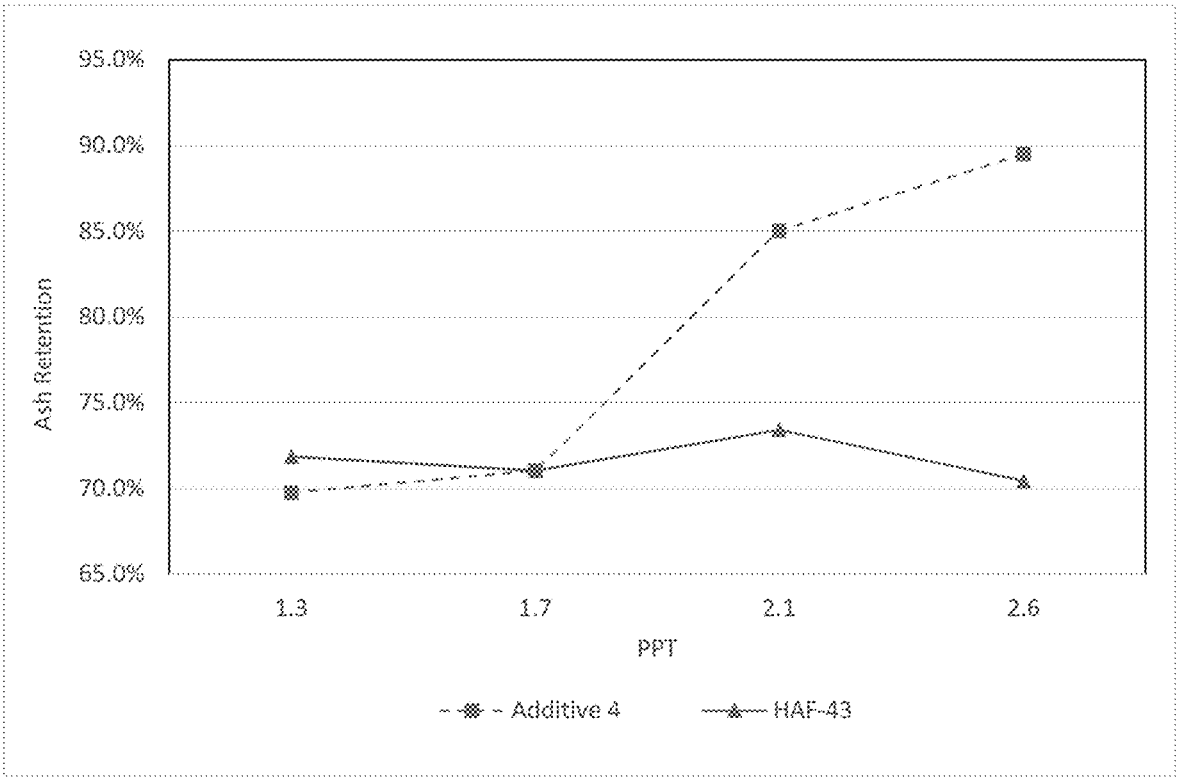
FIG. 2 is a graph showing ash retention (%) as a function of pounds per ton (PPT) of an additive according to the disclosure (Additive 4) and a polyacrylamide polymer additive (HAF-43), alone.

Pulp from a fine paper mill was collected and DDJ testing was completed. The pulp contained about 265 PPT of calcium carbonate as a filler. 500 mL of pulp was mixed with amounts of Additive 4 varying from 1.3 PPT to 2.6 PPT. For comparison, 500 ml of pulp was also treated with polyacrylamide flocculant (HAF-43) alone in the same amounts varying from 1.3 PPT to 2.6 PPT. No coagulant was added. FPR and ash retention were determined, and are shown in FIG. 2.

As shown in the table below and graphically in FIG. 2, as the dosage of Additive 4 increased from 1.3 to 2.6 PPT, the ash retention also increased. In contrast, the ash retention of the sample dosed with HAF-43, alone, plateaued and did not increase as dosage increased.

TABLE 2

| Amount of Additive Used | Additive 4 | Polyacrylamide Flocculant (HAF-43) alone |
|---|---|---|
| 1.3 PPT | 69.8 | 71.9 |
| 1.7 PPT | 71.1 | 71.1 |
| 2.1 PPT | 85.1 | 73.4 |
| 2.6 PPT | 89.5 | 70.5 |

Advantageously, FIG. 2 and Table 2 demonstrate that ash retention continued to increase as the dosage of Additive 4 increased. In contrast, when the polyacrylamide flocculant was used alone, the ash retention plateaued and did not show the significant increase in ash retention above loadings of about 2.1 PPT, as observed when the additive was included.

Example 3: Ash Retention Testing in Molded Fiber Product

A molded fiber machine trial using old news print (ONP) was conducted to demonstrate the efficiency of the additive in a manufacturing facility. Pre-trial baseline conditions of the ONP were as shown in Table 3. The pulp was dosed with GCC as a filler in an amount of 300 PPT (15 wt %). A coagulant (PV-032) was added at 2 PPT to the mix tank, and mixed. 1 PPT Additive 1 was added prior to the vat, before the molding machine. Results are shown in Table 3.

TABLE 3

| | Baseline | Additive 1 |
|---|---|---|
| GCC Content (PPT) | 0 | 300 |
| Final Ash (%) | 7.6 | 17.3-20.2 |

TABLE 3-continued

| | Baseline | Additive 1 |
|---|---|---|
| FPR (%) | 91.3 | 98.0-98.4 |
| Ash Retention (%) | 66.7 | 96.1-97.8 |

As shown in Table 3, the ash retention when Additive 1 was included, the ash retention increased about 48% over the ash retention of the old news print without the additive, even when the amount of filler was increased to 300 PPT.

What is claimed is:

1. An additive for a paper composition, comprising a blend of:

poly(ethylene oxide) (PEO) in an amount of about 1 wt % to about 15 wt %, based on the total weight of the additive; and, a polyacrylamide polymer in an amount of about 20 wt % to 40 wt %, based on the total weight of the additive, wherein the PEO and the polyacrylamide polymer are present in a ratio of about 1:3 to about 1:15 by weight;

wherein the additive is capable of increasing ash retention of a paper composition by at least about 25% relative to ash retention of a paper composition having an additive comprising the PEO alone, an additive comprising the polyacrylamide polymer alone, or the separate addition of both an additive comprising the PEO alone and an additive comprising the polyacrylamide polymer alone.

2. The additive of claim 1, wherein the PEO comprises a dispersion of PEO, and the polyacrylamide polymer comprises a polyacrylamide polymer emulsion.

3. The additive of claim 1, wherein the additive is aqueous.

4. The additive of claim 1, wherein the PEO is present in an amount of about 2 wt % to about 10 wt %, based on the total weight of the additive.

5. The additive of claim 1, wherein the PEO is present in an amount of about 2 wt % to about 5 wt %, based on the total weight of the additive, and the polyacrylamide polymer is present in an amount of about 25 wt % to about 30 wt %, based on the total weight of the additive.

6. The additive of claim 1, further comprising an auxiliary agent selected from the group consisting an emulsifier, a viscosity modifier, a dispersant, a dye fixative, a dry strength agent, a wet strength agent, and any combination thereof.

7. The additive of claim 6, wherein the auxiliary agent is selected from the group consisting of poly(ethylene glycol) (PEG), alum, polyaluminum chloride, sodium alginates, polyamines, polyethylene imine, polydiallyldimethyl ammonium chloride, poly-epichlorohydrin-dimethylamine, polyguanidine, and any combination thereof.

8. The additive of claim 1, wherein the additive is capable of increasing the ash retention of a paper composition by at least about 25% relative to an additive comprising the polyacrylamide polymer, alone.

9. The additive of claim 1, wherein the additive is capable of increasing the ash retention of a paper composition by at least about 50% relative to an additive comprising the PEO, alone.

10. The additive of claim 1, wherein the additive is capable of increasing the ash retention of a paper composition by at least 25% relative to the separate addition of both an additive comprising the PEO alone and an additive comprising the polyacrylamide polymer alone.

11. The additive of claim 1, wherein the additive is capable of increasing the ash retention of a paper composition by at least about 10% of an expected combined ash retention achieved by an additive comprising the polyacrylamide polymer, alone, and an additive comprising the PEO, alone.

12. An additive for a paper composition, comprising a blend of poly(ethylene oxide) (PEO); and, a polyacrylamide polymer, wherein the ratio of the PEO to the polyacrylamide polymer is about 1:3 to about 1:40, and wherein, when added to a paper composition in an amount of at least about 1.7 lb/ton (PPT), the additive is capable of increasing ash retention of the paper composition by at least about 25% relative to ash retention of a paper composition having an additive comprising the PEO alone, an additive comprising the polyacrylamide polymer alone, or the separate addition of both an additive comprising the PEO alone and an additive comprising the polyacrylamide polymer alone.

13. The additive of claim 12, wherein the PEO is present in an amount of less than 15 wt %, based on the total weight of the additive.

14. An additive for a paper composition, comprising a blend of:

a dispersion comprising poly(ethylene oxide) (PEO); and a polyacrylamide polymer emulsion, wherein the ratio of the PEO to the polyacrylamide polymer is about 1:3 to about 1:10, and wherein, when added to a paper composition in an amount of at least about 1.7 lb/ton (PPT), the additive is capable of increasing ash retention of the paper composition by at least about 25% relative to ash retention of a paper composition having an additive comprising the PEO alone, an additive comprising the polyacrylamide polymer alone, or the separate addition of both an additive comprising the PEO alone and an additive comprising the polyacrylamide polymer alone.

15. The additive of claim 14, wherein the PEO is present in an amount of about 2 wt % to about 5 wt %, based on the total weight of the additive, and the polyacrylamide polymer is present in an amount of about 25 wt % to about 30 wt %, based on the total amount of the additive.

16. The additive of claim 15, further comprising sodium formate salt.

17. An additive for a paper composition comprising a blend of:

poly(ethylene oxide) (PEO) in an amount of about 1 wt % to about 15 wt %, based on the total weight of the additive;

a polyacrylamide polymer in an amount of about 20 wt % to 40 wt %, based on the total weight of the additive; and, a salt selected from the group consisting of sodium formate, potassium formate, sodium hydroxide, potassium hydroxide, sodium citrate, potassium citrate, sodium acetate, potassium acetate, sodium chloride, potassium chloride, and mixtures thereof, wherein the additive is capable of increasing ash retention of a paper composition by at least about 25% relative to ash retention of a paper composition having an additive comprising the PEO alone, an additive comprising the polyacrylamide polymer alone, or the separate addition of both an additive comprising the PEO alone and an additive comprising the polyacrylamide polymer alone.

18. The additive of claim 17, wherein the salt comprises sodium formate.

19. A method of making a paper composition, the method comprising admixing a pulp stock and the additive of claim 1 to provide a paper composition furnish, wherein the pulp stock comprises a fiber matrix and a filler material;

drying the paper composition furnish to provide a paper composition, wherein, the paper composition has an ash retention that is at least about 25% higher than a paper composition that does not comprise the polyacrylamide polymer or PEO or a paper composition in which the polyacrylamide polymer and the PEO are added separately.

20. The method of claim 19, wherein the additive is added in an amount ranging from about 0.1 lb/ton (PPT) to about 4 PPT.

21. The method of claim 19, wherein the fiber matrix comprises old corrugated cardboard (OCC), fine paper, old new print (ONP), mixed office waste (MOW), virgin pulp, bleached or unbleached kraft pulp, bleached or unbleached sulphite pulp, recycled fibers, refined cellulose fiber, chemical pulp, mechanical pulp, thermo-mechanical pulp, or a mixture thereof.

22. The method of claim 19, wherein the filler material comprises clay, kaolin, ground calcium carbonate (GCC), precipitated calcium carbonate (PCC), titanium dioxide, talc, a starch, polyvinyl alcohol, carboxymethylcellulose, or a mixture thereof.

23. The method of claim 22, wherein the filler material comprises GCC.

24. The method of claim 19, wherein the paper composition is a newsprint, a supercalendered paper, a coated mechanical paper, a wood-free uncoated paper, a wood-free coated paper, a copy paper, a digital printing paper, a continuous stationery, a fine paper, a carton-board, a containerboard, a cardboard, a linerboard, a wallpaper, a wrapping paper, an envelope paper, a molded container, or a molded pulp shipping liner.

25. The method of claim 19, wherein the pulp stock has a consistency of about 0.05% to about 3.0%.

26. The method of claim 19, wherein the filler material is added in an amount ranging from about 10 PPT to about 500 PPT.

27. The method of claim 19, wherein the filler material is added in an amount ranging from about 200 PPT to about 300 PPT.

28. The method of claim 19, wherein the paper composition furnish further comprises an auxiliary agent selected from the group consisting of an emulsifier, a viscosity modifier, a dispersant, a dye fixative, a dry strength agent, a wet strength agent, and any combination thereof.

29. The method of claim 28, wherein the auxiliary agent is selected from the group consisting of poly(ethylene glycol) (PEG), alum, polyaluminum chloride, sodium alginates, polyamines, polyethylene imine, polydiallyldimethyl ammonium chloride, poly-epichlorohydrin-dimethylamine, polyguanidine, and any combination thereof.

30. The method of claim 29, wherein the auxiliary agent is added in an amount of less than about 5 PPT.

* * * * *